US006102671A

United States Patent [19]

Yamamoto et al.

[11] Patent Number: 6,102,671

[45] Date of Patent: Aug. 15, 2000

[54] SCROLL COMPRESSOR

[75] Inventors: Shuichi Yamamoto; Kiyoshi Sawai, both of Otsu; Taise Kohayakawa, Kusatsu; Shozo Hase, Shiga; Takashi Morimoto, Nagaokakyo; Hiromasa Ashitani; Hiroyuki Fukuhara, both of Shiga, all of Japan

[73] Assignee: Matsushita Electric Industrial Co., Ltd., Osaka, Japan

[21] Appl. No.: 09/131,822

[22] Filed: Aug. 10, 1998

[30] Foreign Application Priority Data

Sep. 4, 1997 [JP] Japan ..... 9-239192

[51] Int. Cl.[7] ..... F04B 49/00

[52] U.S. Cl. ..... 417/310; 417/308

[58] Field of Search ..... 417/308, 310; 418/55.1, 55.2

[56] References Cited

U.S. PATENT DOCUMENTS 4,490,099 12/1984 Terauchi et al. .
4,774,816 10/1988 Uchikawa et al. ..... 62/324.1
5,490,769 2/1996 Calhoun ..... 418/1
5,855,475 1/1999 Fujio et al. ..... 418/15

FOREIGN PATENT DOCUMENTS 58-172405 10/1983 Japan .
5-202871 8/1993 Japan .
5-215085 8/1993 Japan .

*Primary Examiner*—Henry C. Yuen
*Assistant Examiner*—Mahmoud M. Gimie
*Attorney, Agent, or Firm*—Jordan and Hamburg LLP

[57] ABSTRACT

Base wraps 21*a* and 31*a* of a fixed scroll 20 and orbiting scroll 30 both have spiral lengths that satisfy specified compression ratio in low speed drive region. Spiral shaped extension wraps 21*b* and 31*b* are provided for at least one of the base wraps 21*a* and 31*a*, extended from the spiral end position thereof, and a displacement is effected in the direction in which the thickness of the wraps 21 and 31 becomes thinner, at least at either the inner walls of the extension wraps 21*b* and 31*b* or at the outer walls of the wraps 21 and 31 in opposition thereto, making the interrelationship greater.

13 Claims, 12 Drawing Sheets

OPERATING FREQUENCY AND VOLUME WHEN 2ND WRAP IS USED

SCROLL COMPRESSOR

BACKGROUND OF THE INVENTION

1. Field of the Invention

This invention relates primarily to a scroll compressor used in refrigerative air conditioning.

2. Description of the Related Art

The compressor unit in motor driven compressors used in refrigerative air conditioning may be a reciprocating, rotary, or scroll compressor. Of these, the scroll compressor is widely used in practice to obtain its advantages of high efficiency, low noise, and low vibration.

The basic structure, as is well known, comprises a fixed scroll wherein a spiral wrap rises from a base plate, and an orbiting scroll wherein a spiral wrap of more or less the same shape rises from a base plate, both scrolls being meshed together and forming a plurality of compression chambers therebetween. When the orbiting scroll is made to move orbitally about the fixed scroll without itself rotating, the compression chambers suck in coolant from open parts at the periphery of the base plates, and then close as they move toward the center of the base plates, so that their volumes gradually diminish, compressing the coolant and finally discharging it.

The compression ratio of refrigerative air conditioning is normally set between 1.8 and 2.7 or so. However, in the face of increasing demand for smaller sizes and greater operating mode diversification in recent years, there is a trend toward designing the device to have a lower compression ratio in the interest of efficiency.

Japanese Published Unexamined Patent Application Tokkaihei 5-202871 discloses a technology for increasing the coolant discharge volume and preventing a decline in volume efficiency with inducted coolant being heated by the heat of compression. FIG. 13 shows the construction of such device, in which the inside wall surface 100*b* at the spiral end of a wrap 100*a* of a fixed scroll 100 is extended near to the spiral end of a wrap 102*a* of an orbiting scroll 102. The outer wall surface 102*b* of the orbiting scroll 102 from the part opposing the spiral end of the wrap 100*a* of the fixed scroll 100 is continuously displaced inwards toward the spiral end of the orbiting scroll 102. The inside wall surface 100*b* in the extended portion of the fixed scroll 100 is formed by the envelope associated with the orbital motion of the outside wall surface 102*b* at the spiral end of the orbiting scroll 102.

In this device, an additional outside operative space 104 is formed between the inside wall surface 100*b* of the extended portion of the wrap 100*a* of the fixed scroll 100 and the outside wall surface 102*b* of the orbiting scroll 102, and the intake space of the compression chamber 106 increases by this added amount, whereupon the coolant discharge volume is increased. Moreover, since the coolant is inducted into the compression chamber 106 directly from an inlet port 108, it does not come into contact with walls through which compression heat is conducted, and is not heated, wherefore volume efficiency does not decline due to thermal expansion.

However, with the increasing diversification of operating modes, scroll compressors must now operate with variable speeds under inverter control. When variable speed operation is implemented, a wide range of operating conditions can be realized with the same scroll compressor, from apparently high-power operation at high capacity to low-power operation at low capacity.

When such variable speed operation is conducted, however, the volume efficiency is not observed to improve markedly even at high speed operation, as indicated in FIG. 3, and no improved efficiency can be hoped for. Even with the prior art, as graphed in FIG. 3, all of the envelope portion noted above operates as a compression chamber, and coolant discharge volume increases, but, as plotted in FIG. 4C, the power required for compression increases irrespective of the operating speed, and efficiency cannot be greatly improved. In particular, during low-power operations to achieve a high energy saving effect, it becomes necessary to lower the operating speed even further, whereupon efficiency declines markedly due to increased coolant leakage.

SUMMARY OF THE INVENTION

An object of the present invention is to provide a scroll compressor capable of efficiently operating in a wide range from low capacity to high capacity by means of variable operation speed.

In the scroll compressor of the present invention, a fixed scroll wherein a spiral shaped base wrap rises from a base plate, and an orbiting scroll wherein a base wrap having more or less the same spiral shape rises from a base plate, are meshed together, forming a plurality of compression chambers therebetween, the orbiting scroll is made to orbitally move at variable speed about the fixed scroll without itself rotating, the base wraps have sufficient spiral length to satisfy the specified compression ratio in low speed operation, an extension wrap is provided, in at least one of the two base wraps, extending from the position at the spiral end thereof, along the spiral shape thereof, and a displacement surface displaced in the direction in which the wrap thickness becomes thinner is formed on at least one or other of the inner wall of the extension wrap and the outer wall of the other wrap in opposition thereto.

With this configuration, the base wraps of the fixed scroll and the orbiting scroll are designed so that the specified compression ratio is obtained during low speed operation. The extension wrap provided for at least one of these two base wraps, while being in a spiral shape, due to a spiral surface displaced so that the thickness of the wrap becomes thinner in at least one of the other wraps in opposition thereto, is opened to the outside with a large wrap interval, whereupon, during low speed operation, the inducted coolant is readily allowed to escape, and no function is manifested of containing the coolant within a compression chamber, so that the coolant is not oversupplied. Accordingly, the aforementioned base wrap portions alone function effectively, and operation at the designed containment capacity is achieved at high efficiency. As the operating speed increases, however, the coolant containment capability of the extension wrap portion between itself and other wrap portions in opposition thereto rises, whereupon, in the compression phase, oversupply is performed according to how much higher the speed is relative to when operating at low speed, and the actual coolant discharge volume increases. Thereupon, when the mutual spiral surfaces pass through the compression region enlarged by the opposing extended wrap or wraps, roughly the same change is made as when compression is performed at the designed containment capacity by the base wraps during low speed operation, as noted above. Therefore, there is little increase in the compression power, and high efficiency is obtained throughout a wide range, from low speed operation to high speed operation. In addition, stable, highly efficient operation is achieved in any operating speed region, commensurate therewith.

In this case, the compression chambers formed by the base wraps are designed smaller than standard, by which measure coolant leakage loss can be reduced, by operating at a higher speed than the standard operating speed, and high efficiency can be realized. When operating at high speed, moreover, high capacity and high efficiency can be realized with the extension wraps. Accordingly, high efficiency is achieved throughout a wide range, from low capacity to high capacity.

In the scroll compressor of the present invention, moreover, a fixed scroll wherein a spiral shaped base wrap rises from a base plate, and an orbiting scroll wherein a base wrap having more or less the same spiral shape rises from a base plate, are meshed together, forming a plurality of compression chambers therebetween, the orbiting scroll is made to orbitally move at variable speed about the fixed scroll without itself rotating, the intake and containment capacity of one of a pair of compression chambers formed by the base wraps is made smaller than that of the other, an extension wrap is provided, in the base wrap forming the compression chamber having the smaller volume, extending from the position at the spiral end thereof, along the spiral shape thereof, and a displacement surface displaced in the direction in which the wrap thickness becomes thinner is made on at least one or other of the inner wall of the extension wrap and the outer wall of the other wrap in opposition thereto.

To make the volume of one of a pair of intake and containment sections formed by the fixed scroll and the orbiting scroll smaller than the other, in this manner, all that is required is to design a smaller angle at the spiral end points of the base wraps in the fixed scroll and the orbiting scroll. When this is done, the outer diameter of the scroll compressor can be made smaller, by the amount that the volume was reduced, while obtaining the same operating effectiveness from the extension wrap or wraps as described above.

Furthermore, discharge bypass ports are provided in a pair of mutually opposing compression chambers, respectively, and the positions of these discharge bypass ports are made such that they form roughly the same angle from the spiral ends of the base wraps, respectively, along the wrap curve of the orbiting scroll. Thereupon, even if there is a disparity in the compression state depending on whether or not there are extension wraps, the bypass function will be activated at the point where the pressures in the pair of compression chambers become roughly the same, and coolant will be discharged, making it possible to decrease unnecessary over-compression losses.

Furthermore, by providing intake ports in the vicinity of the spiral ends of the extension wraps, one of the pair of intake and containment sections will communicate directly with a coolant intake, and the other, which has not attained a containing state, communicates directly with that portion, formed by the other extension wrap, which becomes a substantially compressing region during high speed operation, wherefore the coolant, during the intake course, is not heated by coming into contact with a wrap wall through which heat of compression is conducted, whereby it is possible to prevent declines in volume efficiency resulting from thermal expansion of the coolant.

Furthermore, the displacement surface noted above is formed so that it slopes relative to the shape of the spiral, in the longitudinal direction toward the spiral end of the extension wrap, so that the thickness of the wrap gradually becomes thinner.

With such configuration, it becomes possible to effect an increase in the coolant discharge volume, and to effect an increase in the coolant discharge volume which is proportional to the amount of increase in the operating speed of the extension wraps, so that even higher efficiency can be obtained. The displacement surface may be formed so that it continues smoothly in the longitudinal direction of the extension wrap, or, alternatively, it may be formed so that it steps down at one or more places in the longitudinal direction toward the spiral end of the extension wrap. The more steps there are midway, the shorter will become each continuously machined spiral surface, thus facilitating fabrication. It is also easy to widen the coolant intake region formed by the extension wrap. It is preferable that the longitudinal length of the extension wrap be set within an angular range of 45° to 360° along the wrap curve, and that the amount of displacement in the displacement surface be set to between 3 and 20% of the wrap thickness. It is preferable that the displacement value be made on the order of 0.5 mm to 0.3 mm over against the common 3 mm in comparatively small scroll compressors.

Furthermore, the terminal position of a tip seal provided on the rising end surface of the wrap of at least one or other of the fixed scroll and orbiting scroll having an extension wrap is established in the vicinity of the terminal end of the extension wrap or, alternatively, in the vicinity of the terminal position of the other wrap in opposition thereto.

With such a configuration as this, by having the tip seal positioned as far as the vicinity of the spiral end of the extension wrap, coolant leakage from the end of the wrap can be effectively reduced when the extension wrap is functioning effectively in conjunction with how high the operating speed is, and higher efficiency can be effected.

Furthermore, a plurality of oiling ports are provided in the surface of the base plate of the fixed scroll, in that part where the extension wrap is provided. The passage area of one oiling port provided at the beginning of the extension wrap is made larger than that of the others.

With such a configuration as this, the amount of oil supplied is greater toward the side where the extension wrap begins and where a high compression ratio occurs when the extension wrap functions effectively in conjunction with how fast the operating speed is, and oil seal effectiveness is enhanced. Thus coolant escape is prevented and oversupply effectiveness is increased, whereupon even greater efficiency can be obtained.

BRIEF DESCRIPTION OF THE DRAWINGS

FIGS. 2A–2D are explanatory diagrams representing operating states of the compressor shown in FIG. 1, wherein FIG. 2A illustrates the state with the orbiting scroll turned 0° (360°), 2B illustrates the state when turned 90°, 2C illustrates the state when turned 180°, and 2D illustrates the state when turned 270°;

FIGS. 7A–7D are explanatory diagrams representing operating states of the compressor in a second embodiment of the present invention, wherein FIG. 7A illustrates the state with the orbiting scroll turned 0° (360°), 7B illustrates the state when turned 90°, 7C illustrates the state when turned 180°, and 7D illustrates the state when turned 270°;

DESCRIPTION OF THE PREFERRED EMBODIMENTS

Preferred embodiments of the present invention are now described, making reference to FIGS. 1 through 12.

(First Embodiment)

Figure 1:
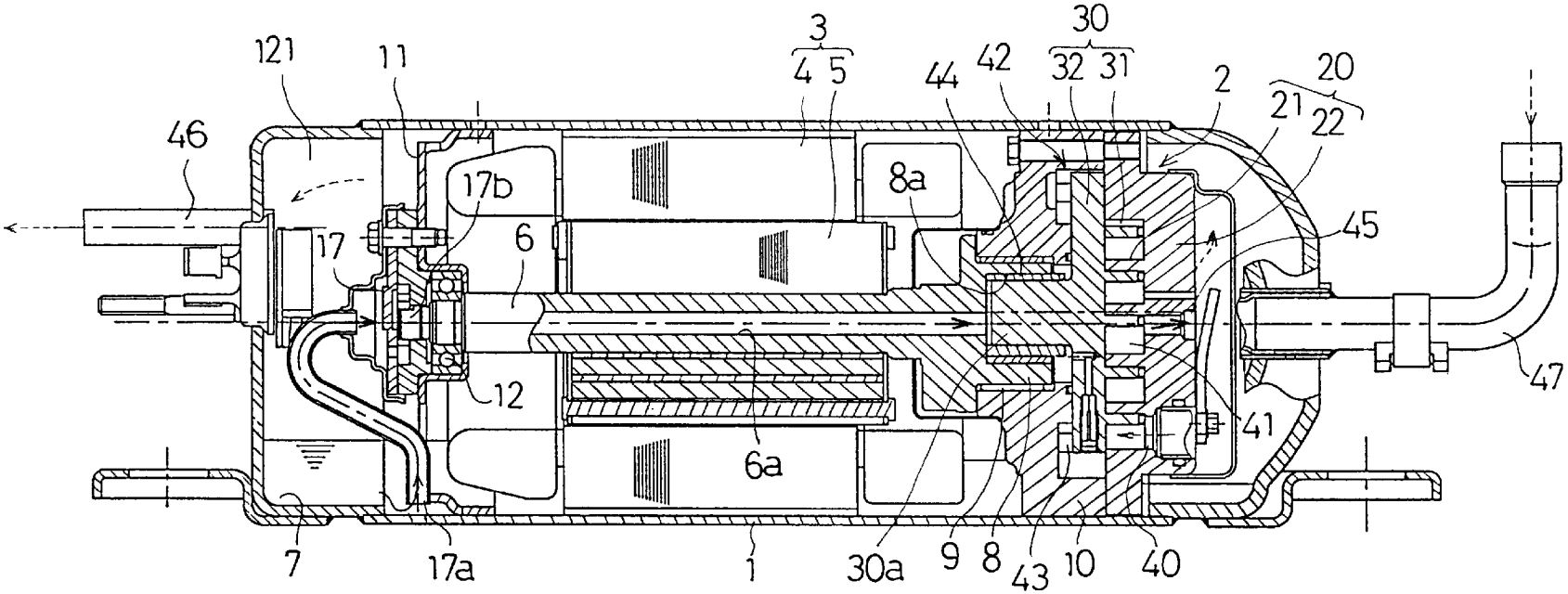
FIG. 1 is a vertical cross-sectional view of a scroll compressor representing a first embodiment of the present invention.
Figure 2B:
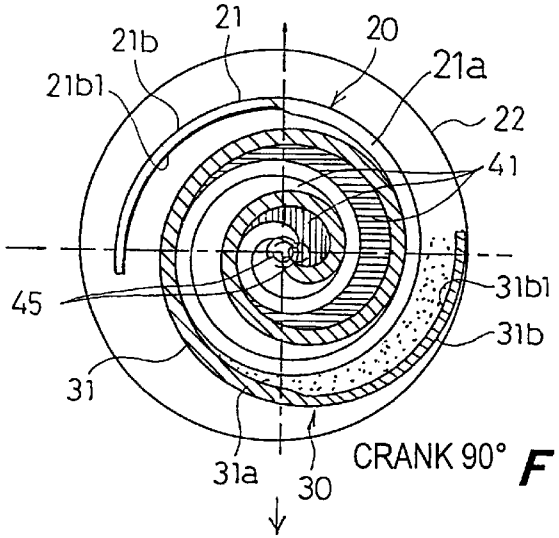
Figure 2C:
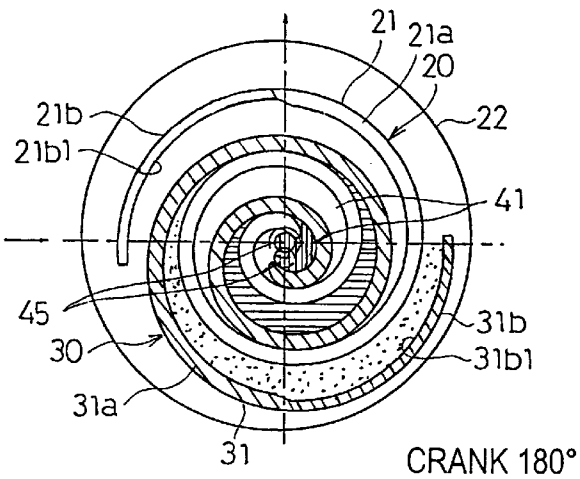
Figure 2A:
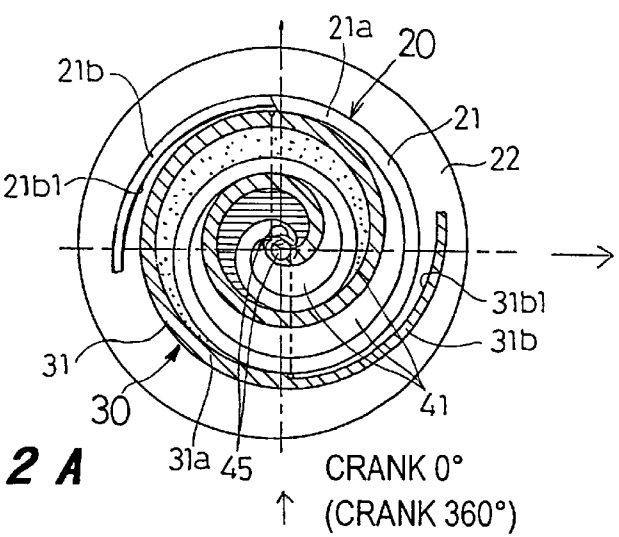
Figure 2D:
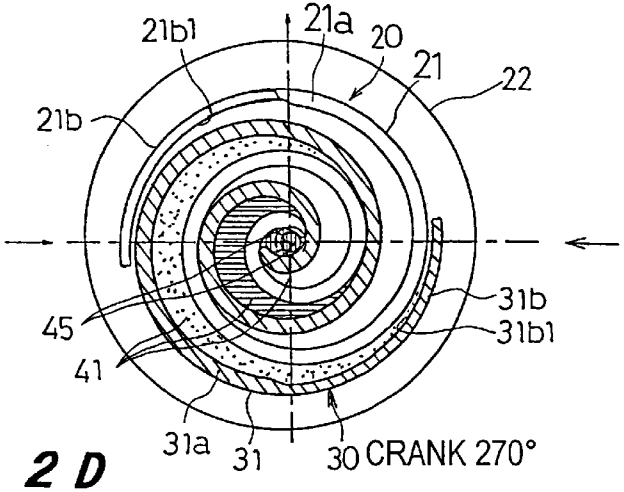

This first embodiment presents one example of a horizontally installed scroll compressor used in refrigerative air conditioning. The overall configuration thereof is shown in FIG. 1. As seen therein, inside a sealed container 1, at one end thereof, a compressor mechanism 2 is provided for inducting, compressing, and discharging coolant. The stator 4 of a motor 3 for driving this compressor mechanism 2 is positioned in the center of the sealed container 1, being secured to the inner surface of the side walls of the sealed container 1. To a rotor 5 corresponding to the stator 4 of the motor 3 is coupled a crankshaft 6 that is the driveshaft for the compressor mechanism 2, the turning shaft of which is arranged so as to be more or less horizontal. The crankshaft 6 has a main shaft 8 at the end thereof toward the compressor mechanism 2, which is supported with a main bearing member 10 screwed to the compressor mechanism 2, while the other end thereof, opposite the end with the main shaft 8, is supported by an auxiliary bearing member 11 positioned at the other end of the sealed container 1, welded in place to the inner surface of the side walls thereof.

Bearings 9 and 12 are also provided at the place where the main shaft 8 at the main bearing member 10 is supported and at the place where the other end of the crankshaft 6 at the auxiliary bearing member 11 is supported. These bearings 9 and 12 support not only the turning of the crankshaft 6 but also the forces which are generated in the crankshaft 6 when the compressor mechanism 2 compresses coolant due to the rotation thereof.

The lower portion inside the sealed container 1, on the end side of the auxiliary bearing member 11, forms a lubricating oil sump 7, while the upper portion thereof forms a discharge chamber 121 for the coolant to the outside of the sealed container 1. On the side of the auxiliary bearing member 11 facing the lubricating oil sump 7 is provided a lubricating oil pump 17 which is driven at the other end of the crankshaft 6. The lubricating oil pump 17 has an intake 17*a* which opens into the lubricating oil sump 7, and a discharge port 17*b* which communicates with a lubricating hole 6*a* formed so as to pass vertically from the other end of the crankshaft 6 to the main shaft 8 portion thereof, by which sliding parts including the bearings of the compressor mechanism 2 are lubricated.

The compressor mechanism 2, as shown in FIGS. 1 and 2, comprises a fixed scroll 20 wherein a spiral wrap 21 rises from a base plate 22, and an orbiting scroll 30 wherein a spiral wrap 31 of more or less the same shape rises from a base plate 32, both scrolls being meshed together and forming a plurality of compression chambers 41 therebetween. The orbiting scroll 30 is made to move orbitally about the fixed scroll 20, at a variable speed, without itself rotating. The motor 3 is controlled by an inverter to effect the variable speed drive, so that the drive can be implemented over a wide operating range, from low speed to high speed.

A rotation-preventing orbiting drive mechanism 42 for imparting an orbital motion to the orbiting scroll 30 without rotating it is configured so that an orbiting shaft 30*a* provided at the back of the orbiting scroll 30 is engaged, such that it can freely rotate, through a bearing 44, into an eccentric hole 8*a* provided in the main shaft 8. When the main shaft 8 rotates, the orbiting scroll 30 is made to move orbitally by an Oldham ring 43 that is a rotation-preventing mechanism.

As the orbiting scroll 30 moves orbitally, the crank sequentially repeats the orbiting states at 0° (360°), 90°, 180°, and 270°, as shown in FIGS. 2A–2D. A compression chamber 41 formed therebetween, by rotation from an open position at the outer periphery of the base plates 22 and 32 shown in FIG. 2B, through FIG. 2C, to the closed position shown in FIG. 2D, inducts coolant, through an inlet port 40 indicated in FIG. 1, as represented by the dotted shading, whereupon, in the course of rotating back to the state of FIG. 2A, it thoroughly contains the coolant, as represented by the dotted shading, and, as the capacity of the compression chamber 41 becomes progressively smaller, as represented by the horizontal hatching, due to the rotation shown through FIGS. 2B, 2C, 2D, and 2A, the coolant is gradually compressed. Whereupon, in the course of the rotation from FIGS. 2B to 2C and 2D, the compression chamber 41 begins to communicate with a discharge port 45, and, while the capacity of the compression chamber 41 is becoming still smaller, as indicated by the vertical hatching, the compressed coolant is discharged through the discharge port 45, as indicated in FIGS. 1 and 2. The discharged coolant is conveyed from the discharge chamber 121 through a discharge pipe 46 to a refrigeration cycle connected externally to the sealed container 1, and is subsequently returned through an intake pipe 47 to the interior of the sealed container 1, whereupon the same action is repeated over and over.

The present invention, however, is not limited to such a horizontal installation, and may be installed in a variety of attitudes, including vertical installations. Moreover, any of various kinds of support structure, drive structure, or drive control method may be selected therefor, so long as the configuration is such that a compression chamber 41 is formed by meshing together a fixed scroll 20 and a orbiting scroll 30, and such that this is driven at variable speeds from low speed to high speed operation.

Corresponding to the fact that the scroll compressor of this embodiment is operated at variable speeds from slow speed to high speed operation, the two base wraps 21*a* and 31*a* of the wraps 21 and 31 have a spiral length that satisfies the specified compression ratio in the low speed drive region. Both of these base wraps 21*a* and 31*a* are provided with spiral shaped extension wraps 21*b* and 31*b* that extend from the spiral end positions thereof farther along the spiral shape, as indicated by the diagonal lines in FIGS. 2A–2D. On the inner walls of these extension wraps 21*b* and 31*b* are provided displacement surfaces 21*b*1 and 31*b*1 displaced in the direction in which the wrap thickness becomes thinner.

Therefore, the base wraps 21*a* and 31*a* of the scroll compressor 20 and orbiting scroll 30 are designed so that the specified containment capacity is obtained during low speed operation. The extension wraps 21*b* and 31*b* provided to both of the base wraps 21*a* and 31*a,* while having a spiral shape, are opened to the outside with a larger interval by the spiral shaped displacement surfaces 21*b*1 and 31*b*1 that are displaced so that the thickness of the wraps becomes thinner. During low speed operation, inducted coolant is readily allowed to escape by the slowness of the rate of change in the order of FIGS. 2C, 2D, and 2A, and no containment function toward the compression chamber 41 is manifested, so there is no coolant oversupply. Accordingly, only the base wraps 21*a* and 31*a* function effectively, and highly efficient operation is achieved with a containment capacity as designed.

Meanwhile, the coolant containment ability of the extension wrap 21*b* and 31*b* portions rises in the intervals with the other wrap portions in opposition thereto, as the operating speed increases, and, in the compression phase, oversupply is performed according to how much faster the speed is relative to what it is at low speed operation, so that the apparent coolant discharge volume increases, whereupon, when the spiral surfaces pass through the compression regions that have been enlarged by the opposing extension wraps 21*b* and 31*b,* roughly the same change is effected as when compressed with the aforementioned design containment capacity by the base wraps 21*a* and 31*a,* so there is little increase in compression power, and high efficiency is obtained over a wide range of operation, from low speed to high speed.

In one example of the first embodiment, in addition to setting the longitudinal length of the extension wraps within an angular range of 45° to 360° about the center of the orbital motion, it is desirable that the amount of displacement in the displacement surfaces 21*b*1 and 31*b*1 be from 3 to 20% or so of the thickness of the wraps, and it is preferable that the displacement value be made on the order of 0.5 mm to 0.3 mm over against the common 3 mm in comparatively small scroll compressors.

Figure 3:
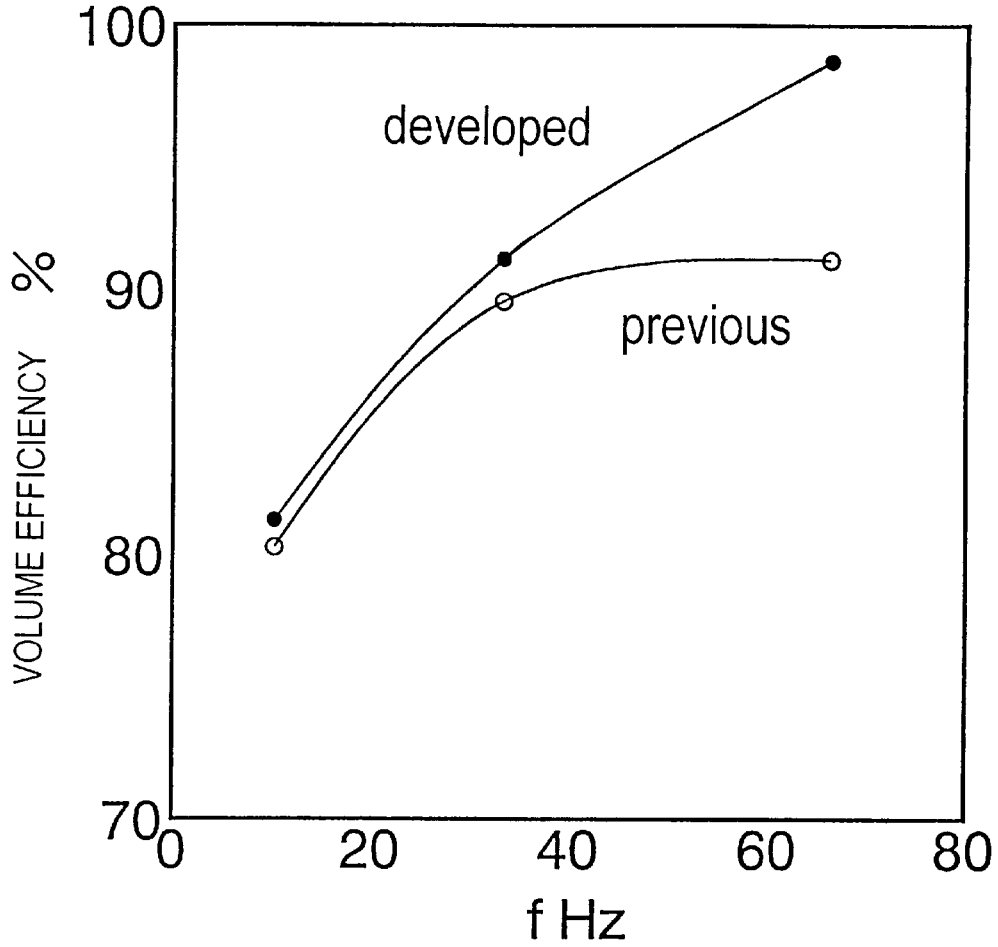
FIG. 3 is a graph comparing differences in volume efficiency between one example of the first embodiment and an example before modification.
Figures 4A, 4B, 4C:
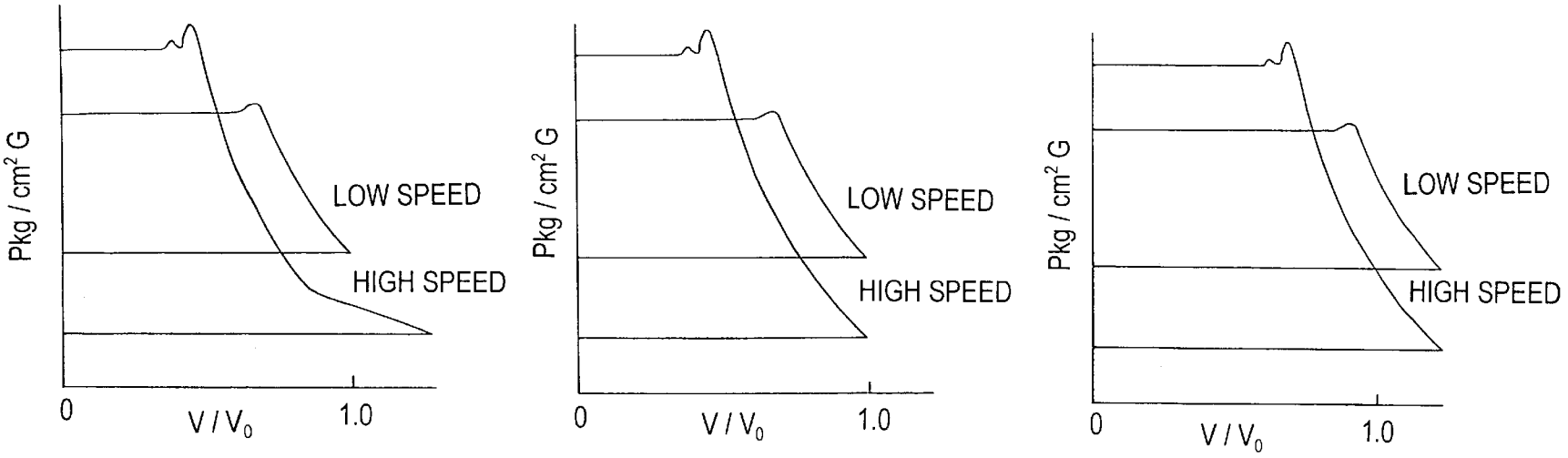
FIGS. 4A–4C are a set of graphs comparing capacity change and pressure change at low and high speed operation between one working example of the first embodiment, an example before modification, and the example of the prior art shown in FIG. 13, wherein the first embodiment is represented at FIG. 4A, the example before modification at 4B, and the prior art example at 4C.

If such a compressor mechanism 2 is compared with a compressor of conventional structure wherein the modifications seen in this first embodiment have not been made, in terms of the change in volume efficiency from low speed to high speed operation, and of the differences in the relationship between pressure and compression chamber capacity at low speed and high speed operation, the results are as plotted in FIG. 3 and in FIGS. 4A and 4B. In the first embodiment represented at FIG. 4A, the containment capacity during high speed operation is increased and efficiency is enhanced as compared to the prior art represented at FIG. 4B.

In addition, by designing the compression chamber 41 formed by the base wraps 21*a* and 31*a* during low speed operation to be smaller than standard, and operating at a speed that is commensurately higher than the standard operating speed, leakage loss can be reduced and high efficiency can be realized. During high speed operation, moreover, high power and high efficiency can be achieved by the extension wraps. Accordingly, even greater efficiencies can be realized over a wide range, from low power to high power.

With this first embodiment, extension wraps 21*b* and 31*b* are provided for both of the base wraps 21*a* and 31*a* in the fixed scroll 20 and orbiting scroll 30, but it is also effective to make this provision for only one of them. Also, it is not absolutely necessary to provide the displacement surfaces 21*b*1 and 31*b*1 on the sides of the extension wraps 21*b* and 31*b,* and they may instead be provided on the surfaces of the wraps opposed thereto, or they may be provided both ways.

Figure 5:
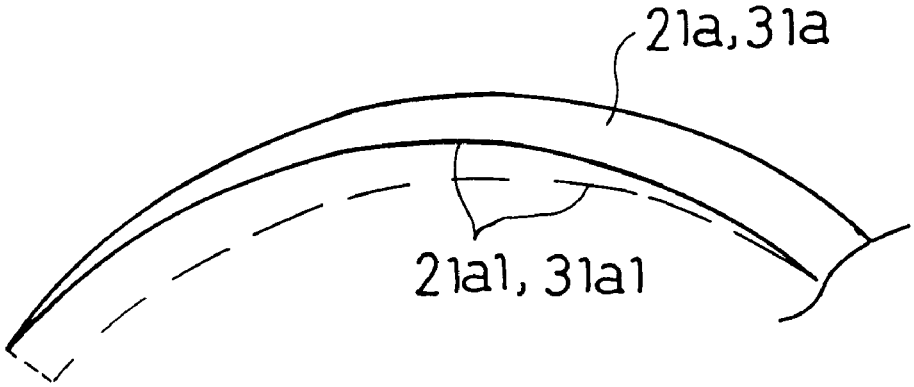
FIG. 5 is a diagram of a critical part representing a different example of the extension wrap of the first embodiment.

As another example of this first embodiment, the displacement surfaces 21*b*1 and 31*b*1 may be formed so that they exhibit a slope relative to the spiral shape, so that the thickness of the wraps gradually becomes thinner in the longitudinal direction toward the spiral ends of the extension wraps 21*b* and 31*b,* as shown in FIG. 5. With this structure, it is possible to effect an increase in the coolant discharge volume, and to effect an increase in the coolant discharge volume which is proportional to the amount of increase in the operating speed of the extension wraps 21*b* and 31*b* , so that even higher efficiency can be obtained.

Figure 6:
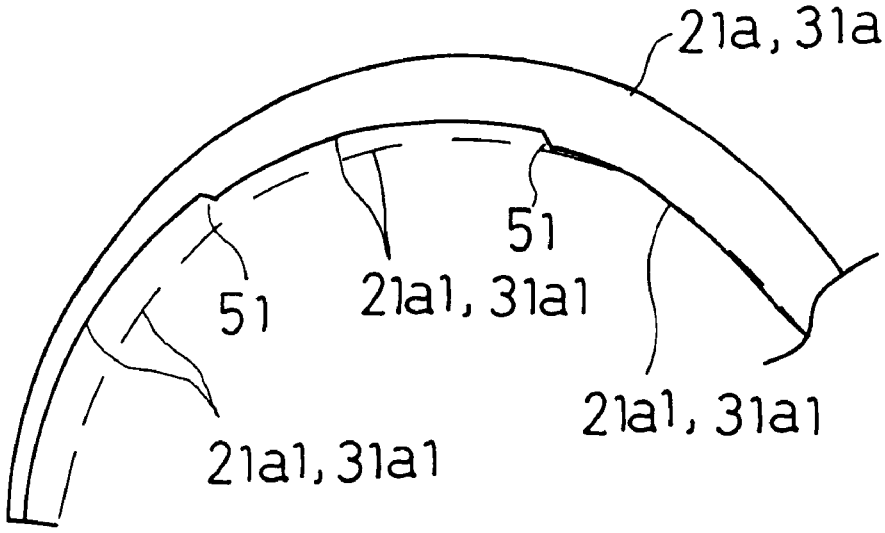
FIG. 6 is a diagram of a critical part representing another example of the extension wrap of the first embodiment.

As yet another example thereof, the displacement surfaces 21*b*1 and 31*b*1 may be formed with steps 51 at one or more places in the longitudinal direction toward the spiral ends of the extension wraps 21*b* and 31*b* , as shown in FIG. 6. The more steps there are midway, the shorter will become each continuously machined spiral surface, thus affording the advantage of easier fabrication. It is also easy to widen the coolant intake region formed by the extension wraps 21*b* and 31*b*.

(Second Embodiment)

Figures 7A, 7B, 7C, 7D:
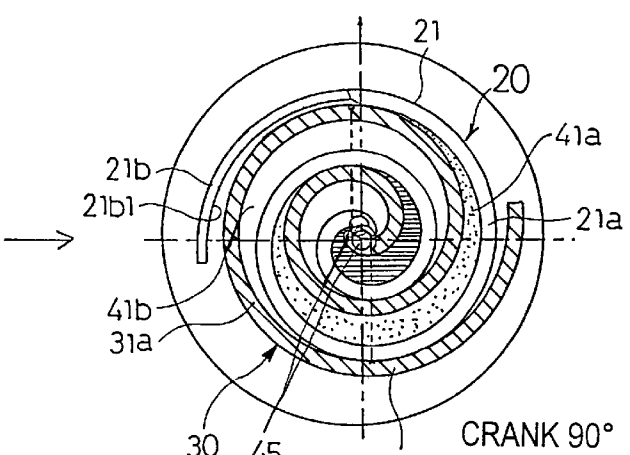

The second embodiment, as shown in FIG. 7, differs from the first embodiment in that the intake and containment capacity of one of the pair of compression chambers 41*a* and 41*b* formed by the base wraps 21*a* and 31*a,* namely of the compression chamber 41*a* indicated in FIG. 7B, is made smaller than the intake and containment capacity of the other compression chamber 41*b* indicated in FIG. 7A. The spiral shaped extension wrap 21*b* represented by the diagonal lines in FIGS. 7A through 7D is provided for the base wrap 21*a* of the wraps 21 of this second embodiment, extended from the spiral end position thereof along the spiral shape thereof. A displacement surface 21*b*1 that is displaced in the direction in which the wrap thickness of the extension wrap 21*b* becomes thinner in this second embodiment is provided at least at the inner wall of the extension wrap 21*b* or at the outer wall of the other wrap 31 in opposition thereto.

To make the volume of one of a pair of intake and containment sections formed by the fixed scroll 20 and the orbiting scroll 30 smaller than the other, in this manner, all that is required is to design a smaller angle at the spiral end points of the base wraps 21*a* and 31*a* in the fixed scroll 20 and orbiting scroll 30. With such a structure, the orbiting scroll 30 repeats the orbiting states from FIGS. 7A to 7D when driven to rotate. In FIG. 7A, compression begins in the compression chamber 41*b* having the larger intake and containment capacity, while in FIG. 7B compression begins in the compression chamber 41*a* having the smaller intake and containment capacity. The coolant compression states in the compression chamber 41*a* are indicated by dotted shading, horizontal hatching, and vertical hatching, as they were in the first embodiment. In this way, while obtaining the same working effect from the extension wrap 21*b* in the compression chamber 41*a* portion as in the first embodiment, the outer diameter of the scroll compressor can be made smaller by the same measure that the aforementioned capacity is made smaller.

Here, if the design is made so that the specified containment capacity at low speed operation is obtained by the length of the base wrap 21*a* out to the spiral end, the same working effects will be obtained as at slow speed operation in the first embodiment.

(Third Embodiment)

Figure 8B:
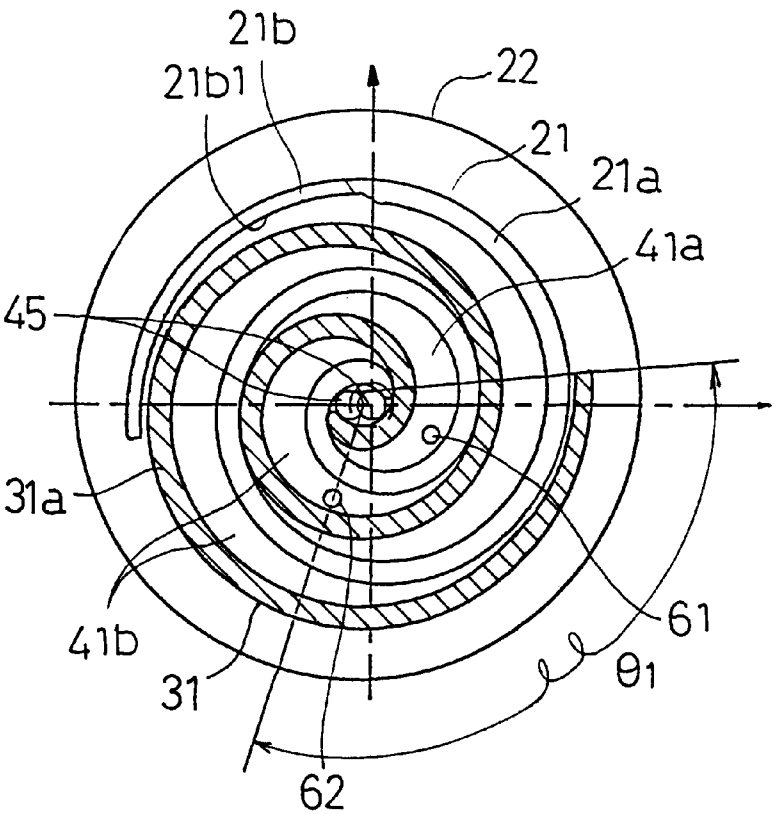
FIGS. 8A and 8B are diagrams of a critical part representing operating states of a compressor in a third embodiment of the present invention, wherein at FIG. 8A is indicated the position of the compression starting point of a compression chamber bounded by the inner wall of the fixed scroll, and at 8B is indicated the position of the compression starting point of a compression chamber bounded by the inner wall of the orbiting scroll.
Figure 8A:
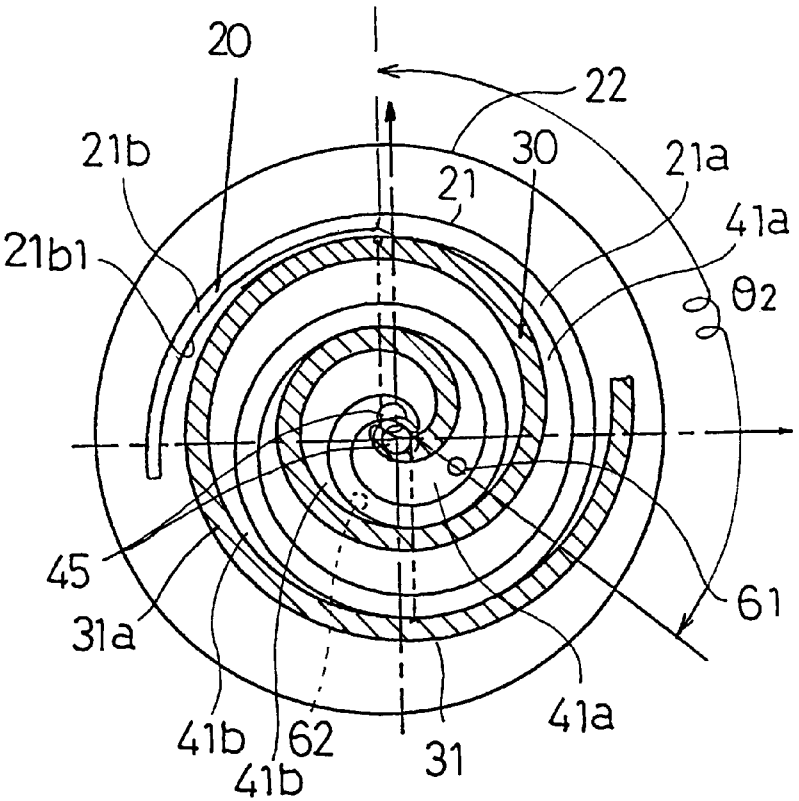

In the third embodiment, as shown in FIGS. 8A and 8B, in the pair of compression chambers 41*a* and 41*b* as indicated in the second embodiment, discharge bypass ports 61 and 62 are provided, respectively. The positions of these discharge bypass ports 61 and 62, respectively, are made so that roughly the same angle is formed from the spiral ends of base wraps 21*a* and 31*a,* along the wrap curves.

Figure 9:
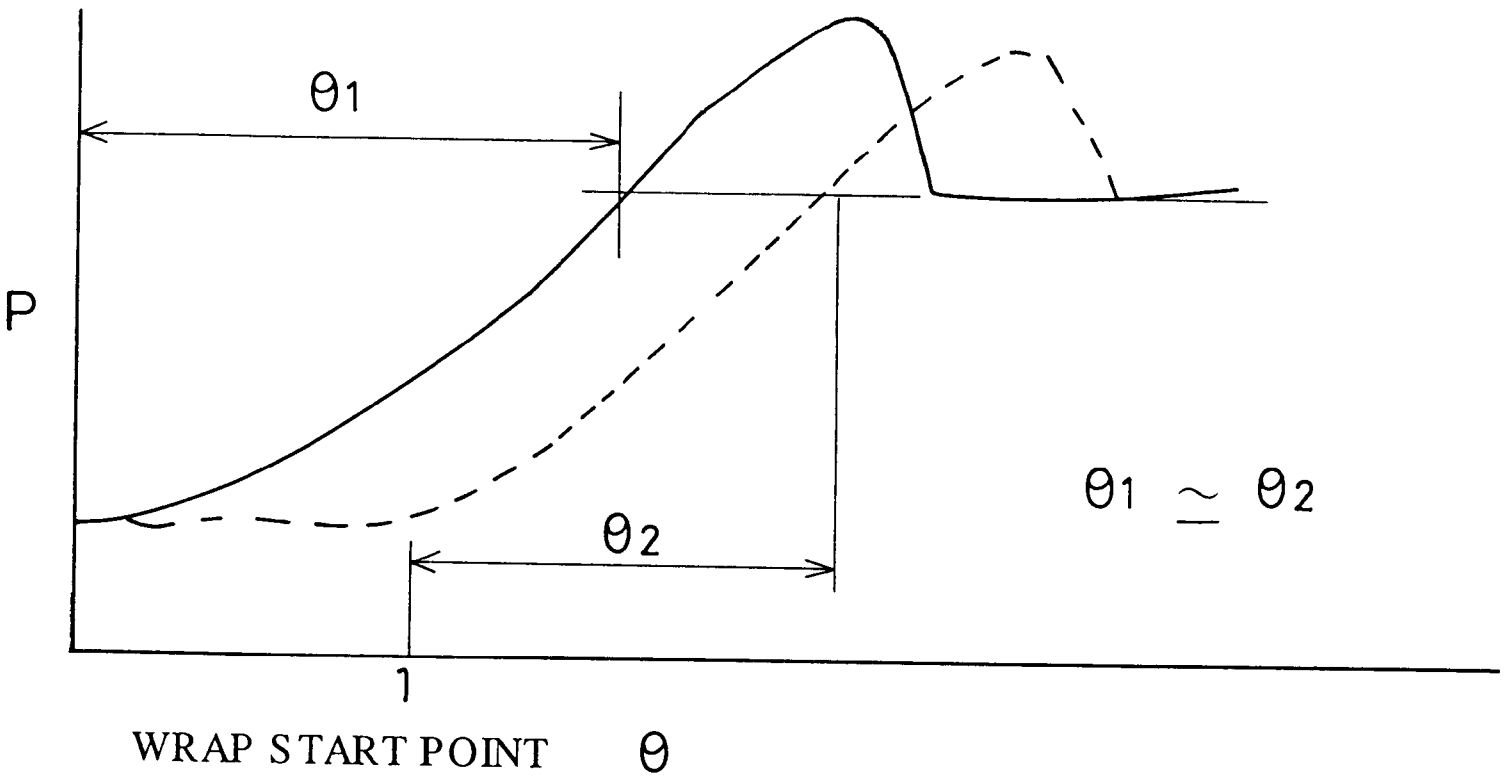
FIG. 9 is a graph representing the pressure changes and the position where the bypass mechanism begins to function during one cycle of a pair of compression chambers in the compressor shown in FIG. 8.

With this structure, the positions of the discharge bypass ports 61 and 62 form roughly the same angle from the spiral ends of the base wraps 21*a* and 31*a,* so that, depending on whether or not there are extension wraps, even if there are timing and value differences in the compression states of the pair of compression chambers 41*a* and 41*b,* as graphed in FIG. 9, the bypass function will be activated at the point where the pressure in both chambers is roughly the same, and coolant will be discharged, wherefore unnecessary excess over-compression compression losses can be reduced. In this regard, the same effectiveness can be obtained by applying the bypass ports 61 and 62 of this third embodiment to the first embodiment.

(Fourth Embodiment)

Figure 10B:
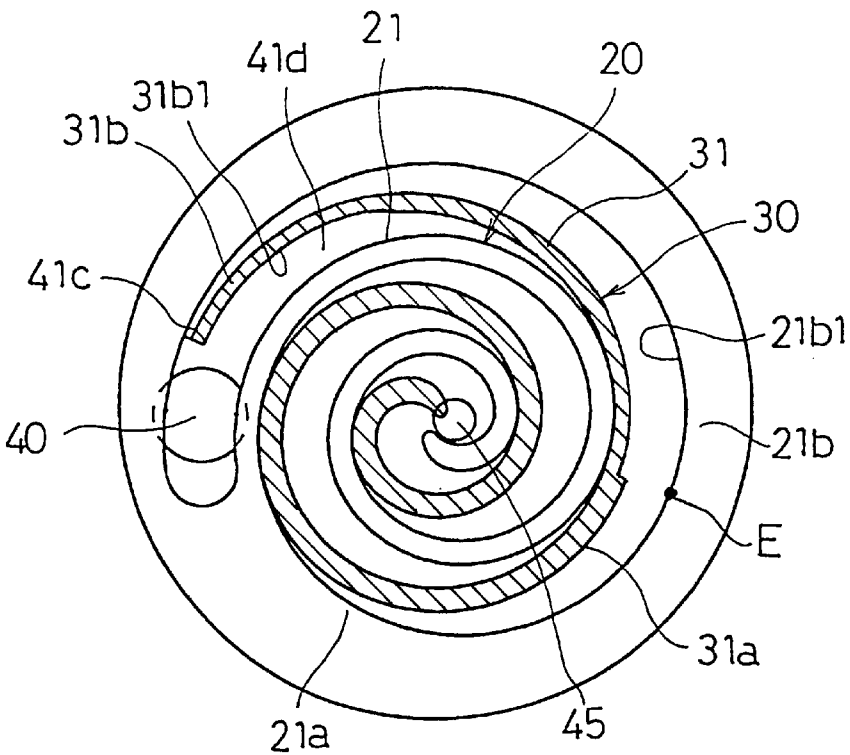
FIGS. 10A and 10B are diagrams of a critical part representing the operating states of the compressor in a fourth embodiment of the present invention, wherein at FIG. 10A is represented the case of an example wherein a displacement surface is provided on the inner wall of an extension wrap in the fixed scroll, and at 10B is represented the case of an example wherein the displacement surface is provided at the outer wall of the fixed scroll.
Figure 10A:
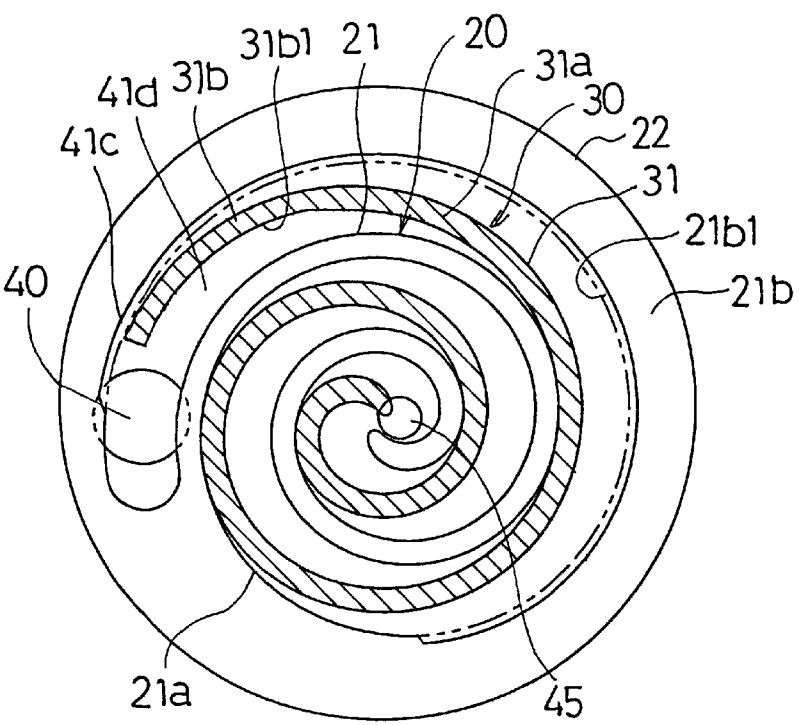

In the fourth embodiment, as is shown in two examples shown in FIGS. 10A and 10B, respectively, an intake port 40 is provided in the vicinity of the spiral end of the extension wrap 21*b.* In the example shown in FIG. 10A, a displacement surface 21*b* 1 is provided to a portion of the fixed scroll 20 which is substantially the extension wrap 21*b,* while in the example shown in FIG. 10B, a displacement surface 21*b* 1 provided after point E in the extension wrap 21*b* of the fixed scroll 20 is provided at the outer wall of the wrap 31 of the orbiting scroll 30 that is in opposition to the extension wrap 21*b.*

In all of the examples, one of a pair of intake and containment sections, namely the one that is contained by the extension wrap 21*b,* is such that the part 41*d* which substantially becomes a compression region at high speed operation communicates more or less directly with the intake port 40, so that, in the intake phase, the coolant is not heated by coming into contact with the wrap walls through which heat of compression is being conducted, as a consequence of which declines in volume efficiency resulting from thermal expansion of the coolant can be prevented.

(Fifth Embodiment)

Figure 11:
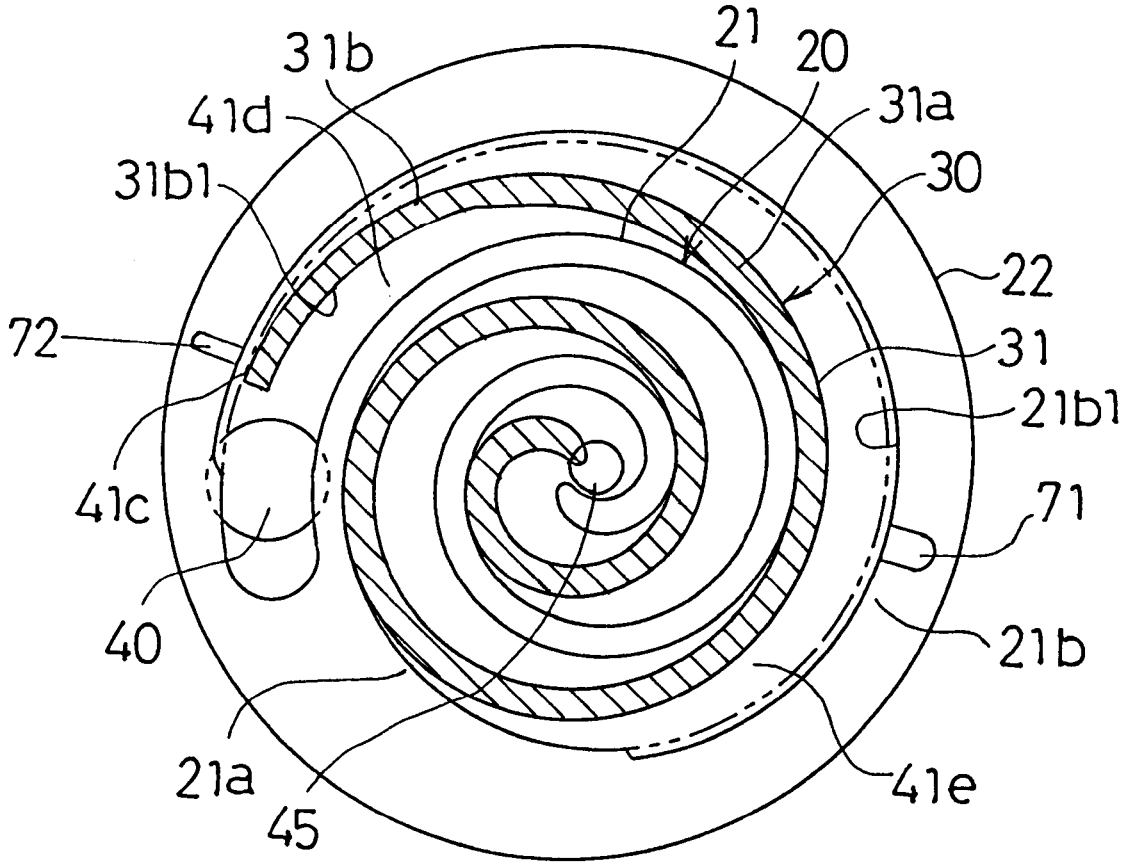
FIG. 11 is a diagram of a compressor in a fifth embodiment of the present invention.

In this fifth embodiment, as shown in FIG. 11, a plurality of oiling ports 71 and 72 are provided in the surface of the base plate 22 of the fixed scroll 20 that is the same as represented in the fourth embodiment, where the extension wrap 21*b* is provided. These oiling ports 71 and 72 are fashioned so that one passage area thereof 71 which is provided at the extension wrap 21*b* side facing toward the compression chamber 41*e* is made larger than that of the other 72.

With this structure, the amount of oil supply toward the compression chamber 4l*e* made by the containment of the extension wrap 21*b* is large, and the oil seal effect is enhanced, whereby coolant escape is prevented and the oversupply effect is increased, wherefore even higher efficiencies can be realized.

(Sixth Embodiment)

Figure 12:
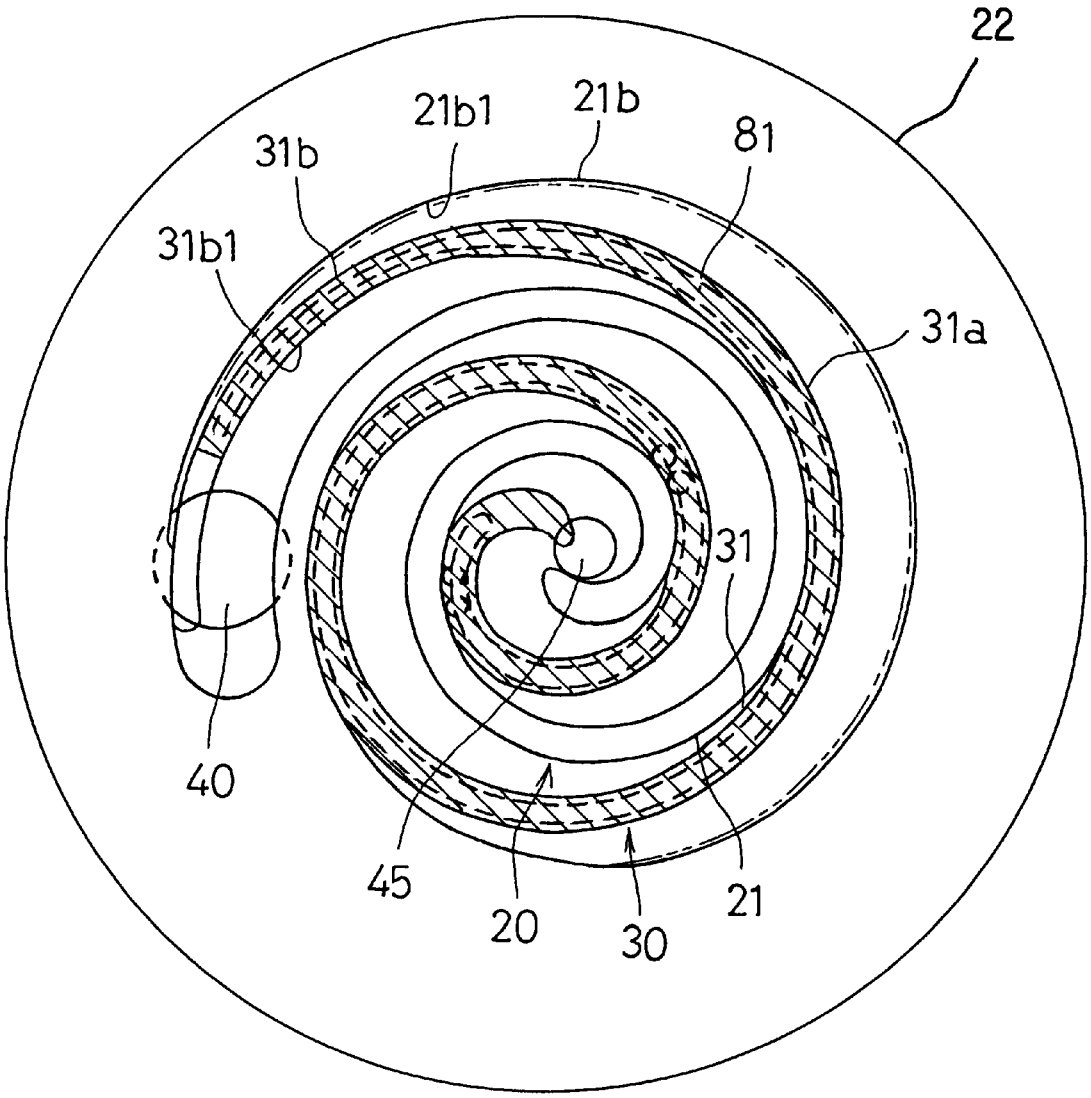
FIG. 12 is a diagram of an operating state of a compressor in a sixth embodiment of the present invention.
Figure 13:
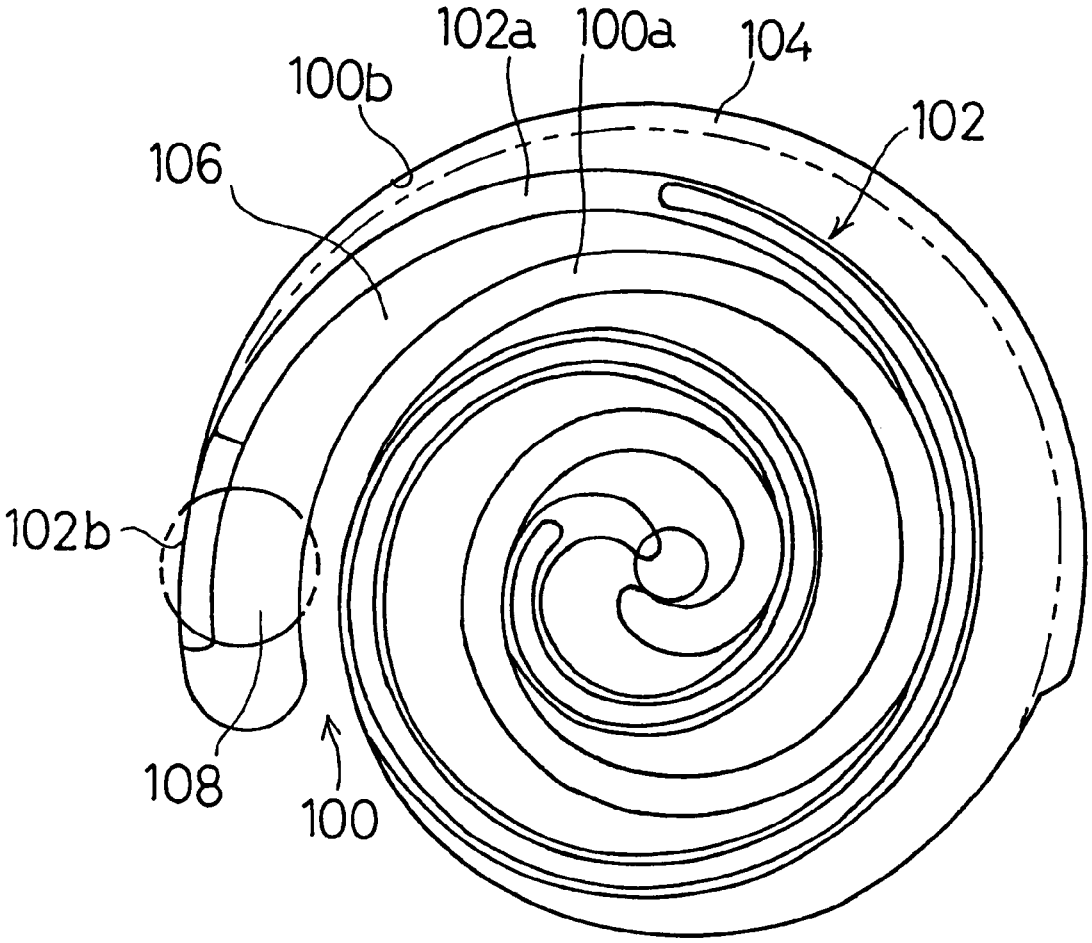
Fig. 13 Prior Art
FIG. 13 is a diagram of a conventional compressor.

In this sixth embodiment, as shown in FIG. 12, a tip seal 81 is provided at the rising end of at least one of the wraps 21 and 31 in the fixed scroll 20 and orbiting scroll 30 (that being the wrap 31 in the orbiting scroll 30 in the sixth embodiment). The termination of this tip seal 81 is made to be either in the vicinity of the terminating position of the extension wrap 31*b* therein, or, alternatively, in the vicinity of the terminating position of the extension wrap 21*b* that is in opposition thereto.

With this structure, because the tip seal 81 is positioned as far as the vicinity of the spiral ends of the extension wraps 21*b* and 31*b,* lateral leakage of coolant can be reduced when the extension wraps 21*b* and 31*b* function effectively in conjunction with how high the speed of operation is, and higher efficiency can be realized. By combining the seal structure of this sixth embodiment with the oiling port structure of the fifth embodiment, still higher efficiency can be realized by effecting even greater coolant Leakage prevention.

While a preferred embodiment of the invention has been described using specific terms, such description is for illustrative purposes only, and it is to be understood that changes and variations may be made without departing from the spirit or scope of the following claims.

What is claimed is:

1. A scroll compressor operable at variable speeds, comprising:

a fixed scroll wherein a spiral shaped base wrap rises from a base plate, and an orbiting scroll wherein a base wrap having generally the same spiral shape rises from a base plate, said fixed scroll and orbiting scroll being meshed together so as to form a plurality of compression chambers therebetween, and said orbiting scroll being made to orbitally move at variable speed in relation to said fixed scroll without itself rotating; wherein both base wraps have sufficient spiral length to satisfy a specified compression ratio in low speed operation;

an extension wrap is provided, in at least one of said two base wraps, extending from a position at a spiral end thereof, along spiral shape thereof; and a displacement surface displaced in a direction in which a wrap thickness becomes thinner is formed on at least one of an inner wall of said extension wrap and outer wall of other wrap in opposition thereto, in an amount such that a predetermined containment capacity is obtained by the extension wrap in high speed operation while said containment capacity is not obtained by the extension wrap in low speed operation.

2. The scroll compressor according to claim 1, wherein:

discharge bypass ports are provided, respectively, in said pair of compression chambers having different intake and compression capacities; and positions of said discharge bypass ports are made such that they form roughly identical angles from the spiral ends of said base wraps, respectively, along a wrap curve of said orbiting scroll.

3. The scroll compressor according to claim 1, wherein an intake port is provided in a vicinity of the spiral ends of said extension wraps.

4. The scroll compressor according to claim 1, wherein said displacement surface is formed so as to slope with respect to a shape of a spiral, in a longitudinal direction toward the spiral end of said extension wrap, so that the wrap thickness of said wrap gradually becomes thinner.

5. The scroll compressor according to claim 1, wherein said displacement surface is formed so as to continue smoothly in a longitudinal direction of said extension wrap.

6. The scroll compressor according to claim 1, wherein said displacement surface is formed so as to step down at at least one place in a longitudinal direction toward the spiral end of said extension wrap.

7. The scroll compressor according to claim 1, wherein a longitudinal length of said extension wrap is set within an angular range of 45° to 360° along a wrap curve, and an amount of displacement in said displacement surface is set to between 3 and 20% of the wrap thickness.

8. The scroll compressor according to claim 1, wherein a tip seal is provided on a rising end surface of the wrap of at least one of said fixed scroll and orbiting scroll having an extension wrap, and a terminal position of said tip seal is established in one of a vicinity of a terminal end of said extension wrap and in a vicinity of a terminal position of a remaining wrap in opposition thereto.

9. The scroll compressor according to claim 1, wherein a plurality of oiling ports are provided in a surface of said base plate of said fixed scroll, at positions where said extension wrap is provided; and a passage area of one oiling port which is provided on a side of beginning of the extension wrap of the fixed scroll is made larger than that of the other.

10. The scroll compressor according to claim 1, wherein the displacement surface is displaced in an amount of 0.3 to 0.5 mm.

11. A scroll compressor operable at variable speeds, comprising:

a fixed scroll wherein a spiral shaped base wrap rises from a base plate, and an orbiting scroll wherein a base wrap having generally the same spiral shape rises from a base plate, said fixed scroll and orbiting scroll being meshed together so as to form a plurality of compression chambers therebetween, and said orbiting scroll being made to orbitally move at variable speed in relation to said fixed scroll without itself rotating; wherein intake and containment capacity of one of a pair of compression chambers formed by said base wraps is made smaller than that of other;

an extension wrap is provided, in the base wrap forming the compression chamber having smaller volume, extending from a position at spiral end thereof, along spiral shape thereof; and a displacement surface displaced in direction in which wrap thickness becomes thinner is made on at least one of an inner wall of said extension wrap and outer wall of other wrap in opposition thereto, in an amount such that a predetermined containment capacity is obtained by the extension wrap in high speed operation, while said containment capacity is not obtained by the extension wrap in low speed operation.

12. The scroll compressor according to claim 11, wherein:

discharge bypass ports are provided, respectively, in said pair of compression chambers having different intake and compression capacities; and positions of said discharge bypass ports are made such that they form roughly identical angles from the spiral ends of said base wraps, respectively, along a wrap curve of said orbiting scroll.

13. The scroll compressor according to claim 11, wherein the displacement surface is displaced in an amount of 0.3 to 0.5 mm.

* * * * *